US011247834B2

(12) United States Patent
Boulez

(10) Patent No.: US 11,247,834 B2
(45) Date of Patent: Feb. 15, 2022

(54) MIXING VESSEL ADAPTABLE TO ANY RECEIVING VESSEL

(71) Applicant: R&O LAB SPRL, Gembloux (BE)

(72) Inventor: Coralie Boulez, Groot-Bijgaarden (BE)

(73) Assignee: R&O LAB SPRL, Gembloux (BE)

( * ) Notice: Subject to any disclaimer, the term of this patent is extended or adjusted under 35 U.S.C. 154(b) by 75 days.

(21) Appl. No.: 16/311,720

(22) PCT Filed: Jun. 21, 2017

(86) PCT No.: PCT/EP2017/065258
§ 371 (c)(1),
(2) Date: Dec. 20, 2018

(87) PCT Pub. No.: WO2018/001826
PCT Pub. Date: Jan. 4, 2018

(65) Prior Publication Data

US 2019/0210787 A1 Jul. 11, 2019

(30) Foreign Application Priority Data

Jun. 28, 2016 (BE) ..... 2016/5487

(51) Int. Cl.
*B65D 81/32* (2006.01)

(52) U.S. Cl.
CPC ..... *B65D 81/3205* (2013.01)

(58) Field of Classification Search
CPC ..... B65D 81/3205
USPC ..... 206/219
See application file for complete search history.

(56) References Cited

U.S. PATENT DOCUMENTS 3,877,499 A * 4/1975 Fluster ..... B67C 9/00 141/310
5,186,323 A * 2/1993 Pfleger ..... B65D 81/3211 206/221
5,277,303 A * 1/1994 Goyet ..... B65D 81/3211 206/219

(Continued)

FOREIGN PATENT DOCUMENTS

DE 29823254 U1 3/1999
FR 2618763 A2 2/1989

(Continued)

OTHER PUBLICATIONS

Written Opinion in corresponding PCT Application No. PCT/EP2017/065258, dated Jul. 24, 2017.

(Continued)

*Primary Examiner* — J. Gregory Pickett
*Assistant Examiner* — Jenine Pagan
(74) *Attorney, Agent, or Firm* — Leason Ellis LLP

(57) ABSTRACT

The invention concerns a mixing vessel (1) for containing a product to be mixed with other content in a receiving vessel (18), said mixing vessel comprising a container (2) and an adapter (3), said container comprising a neck (4) intended to be mounted on a neck of the receiving vessel via the adapter, the neck of the container being a universal neck that can be used on any receiving vessel comprising a neck of any size, said adapter (3) comprising a removable lid (5) for opening the mixing vessel (1) on the receiving vessel (18) such that the product of the mixing vessel and the product of the receiving vessel mix.

4 Claims, 4 Drawing Sheets

(56) References Cited

U.S. PATENT DOCUMENTS 5,743,312 A * 4/1998 Pfeifer ..... A61J 1/2089 141/329
6,237,649 B1 * 5/2001 Moisio ..... B65D 81/3211 141/100
7,210,508 B2 * 5/2007 Behar ..... A45D 34/02 141/319
7,607,460 B2 * 10/2009 Johns ..... B65D 81/3211 141/319
8,226,126 B2 * 7/2012 Johns ..... B01F 15/0212 285/3
8,371,483 B2 * 2/2013 Sanford ..... B67C 9/00 222/570
8,459,450 B1 * 6/2013 Whitaker ..... A61J 9/00 206/219
9,016,488 B1 * 4/2015 Peres ..... A61J 9/008 215/6
9,339,439 B2 * 5/2016 Nudo ..... A61J 1/2089
2004/0089563 A1 * 5/2004 Sharon ..... B65D 81/3211 206/219
2005/0279653 A1 * 12/2005 Williams-Lucas ..... B65D 51/2892 206/219
2006/0251771 A1 * 11/2006 Yokota ..... B65D 51/2835 426/115
2007/0039975 A1 * 2/2007 Bochtler ..... B65D 81/3211 222/142.5
2009/0188884 A1 * 7/2009 Nelson ..... B65D 81/3205 215/6
2011/0290805 A1 * 12/2011 Rances ..... B65D 25/04 220/529
2015/0203274 A1 * 7/2015 Gitta ..... B65D 81/3211 206/219
2017/0354289 A1 * 12/2017 Marina ..... A47J 31/407

FOREIGN PATENT DOCUMENTS

WO 9909931 A1 3/1999
WO 2007145773 A2 12/2007

OTHER PUBLICATIONS

International Search Report in corresponding PCT Application No. PCT/EP2017/065258, dated Jul. 24, 2017.
International Preliminary Report on Patentability in corresponding PCT Application No. PCT/EP2017/065258, dated Jan. 1, 2019.

* cited by examiner

MIXING VESSEL ADAPTABLE TO ANY RECEIVING VESSEL

CROSS-REFERENCE TO RELATED PATENT APPLICATIONS

This application is a U.S. National Stage Application under 35 U.S.C. § 371 of International Patent Application No. PCT/EP2017/065258, filed Jun. 21, 2017, which claims the benefit of priority under 35 U.S.C. Section 119(e) of Belgium Patent Application number 2016/5487 filed Jun. 28, 2016, both of which are incorporated by reference in their entireties. The International Application was published on Jan. 4, 2018, as International Publication No. WO 2018/001826 A1.

FIELD OF THE INVENTION

The invention relates to vessels, or capsules, containing a product intended to be mixed with another product contained in another vessel, generally a flask, a can, a bottle, etc.

STATE OF THE ART

There are currently various capsules that are screwed onto a bottle neck, in order to pour their contents therein.

Document US2014/0305817A1 describes such a capsule to be screwed onto the neck of a bottle. This capsule comprises a receptacle for a liquid or a powder and a neck to screw on the neck of a bottle, itself also containing a liquid or a powder. One side of the lid is closed and the other side, i.e. on the side of its neck, is closed by a seal so that the capsule is hermetic before its product is used.

As illustrated in FIG. 1, the capsule 13 of the prior art is composed of a receptacle 10 in which the product to be diluted is stored. This product can be liquid or powder, for example. The capsule 13 is closed hermetically on one side, and on the other, neck side 14, by a seal 11 connected to a periphery 14 by a tubular cylinder 16. When a user wishes to dilute the product of the capsule 13, he must choose, for example, a bottle 8 whose neck 7 is adapted to the neck 14 of the capsule. This bottle 8 may contain water or any other liquid or powder product according to use.

The user will then screw the capsule 13, hitherto closed hermetically by the seal 11, on the neck 7 of the bottle 8. The neck 7 will exert a pressure leading to the periphery 14 with its cylinder 16, which will cause the seal 11 to detach along a tear line except in a hinge zone. The seal, after its pivoting, opens the capsule 13 to release its contents that will flow into the bottle 8.

This capsule has the advantage of being able to hermetically contain a precise dose of product until its use. The manipulation is simply performed by screwing this capsule on a bottle in order to release the product therein. Such a capsule is convenient because it is manufactured in such a way as to contain the desired dose of product.

Nevertheless, such a capsule has a certain disadvantage. Indeed, it has little flexibility. Indeed, its neck is adapted to only one type of bottle. As the entire capsule is molded, the mold must be adapted both to the volume of the capsule and to the size of the neck of the bottle.

Depending on the type of product contained in the capsule, this product will have to be more or less diluted. Therefore, the size of the capsule will vary, as will the size of the neck to be compatible with bottles of different volumes. In addition, the introduction of the seal in the capsule is made by striking, with a risk of breaking a portion of the capsule, for example the lid which closes the side opposite its neck.

The invention of the present application aims to overcome these drawbacks.

SUMMARY OF THE INVENTION

For this purpose, the present application relates first of all to a mixing vessel for containing a product to be mixed with another content in a receiving vessel, said mixing vessel comprising a container and an adapter, said container comprising a neck designed to be mounted on a neck of the receiving vessel via the adapter, the neck of the container being a universal neck used on any receiving vessel having a neck of any size, said adapter comprising a removable seal for opening the mixing vessel on the receiving vessel so that the product of the mixing vessel and the product of the receiving vessel can mix.

This mixing vessel with universal neck of the invention is designed to be able to contain any volume of product, and to be fixed on a receiving vessel having a neck of any size. Indeed, the mixing vessel comprises, on the one hand, a container of any volume but having a universal neck and, on the other hand, an adapter that allows to hang this container to a receiving vessel comprising a neck of any size.

This vessel of the invention has a great flexibility, because it suffices to choose, on the one hand, the volume of the container and, on the other hand, the diameter of the neck of the adapter, and to assemble these two elements to make it the adequate mixing vessel.

In addition, the finished product is composed of two pieces instead of three, because the seal is part of the same piece as the adapter.

Advantageously, the adapter of the vessel of the invention comprises an adapter skirt and a fastening skirt between which the seal is located.

Thus, the adapter can be clipped using the adapter skirt on any container, the assembly forming the mixing vessel of the invention.

The invention also concerns, as an intermediate product, an adapter for acting as an intermediate between a container of a mixing vessel and a receiving vessel, said adapter comprising an adapter skirt and a fastening skirt, said adapter skirt comprising means for fixing on a universal container neck and said fastening skirt being intended to be fixed on a receiving vessel neck, said adapter comprising a removable seal designed to open the mixing vessel on the receiving vessel so that the product of the mixing vessel and the product of the receiving vessel can mix.

The applicant intends to emphasize that the mixing vessel and the intermediate adapter are undeniably linked by the same inventive concept.

BRIEF DESCRIPTION OF THE FIGURES

The invention will be better understood with the aid of the following detailed description, made with reference to the drawing in the appendix, in which.

DETAILED DESCRIPTION OF THE INVENTION

Figure 1:
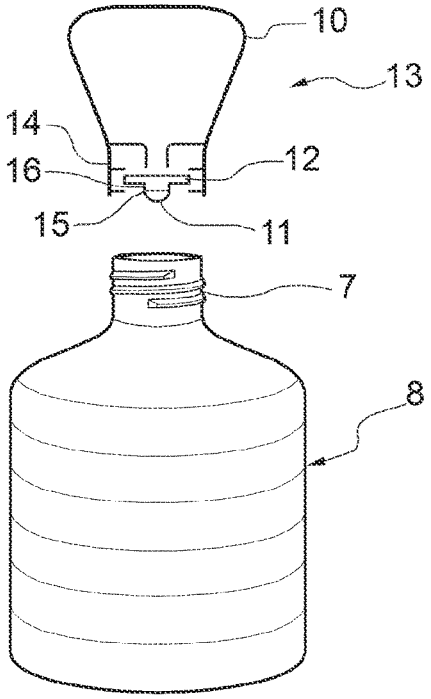
FIG. 1 is a schematic view, partly seen from the front, partly in section, of a container of the prior art.
Figure 2:
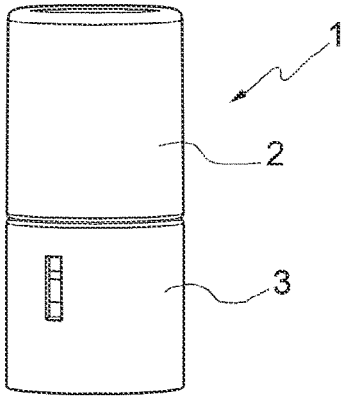
FIG. 2 is a front view of the vessel of the invention.

The mixing vessel 1 of the invention, in FIG. 2, is composed of a container 2 and an adapter 3 joined together.

Figure 3:
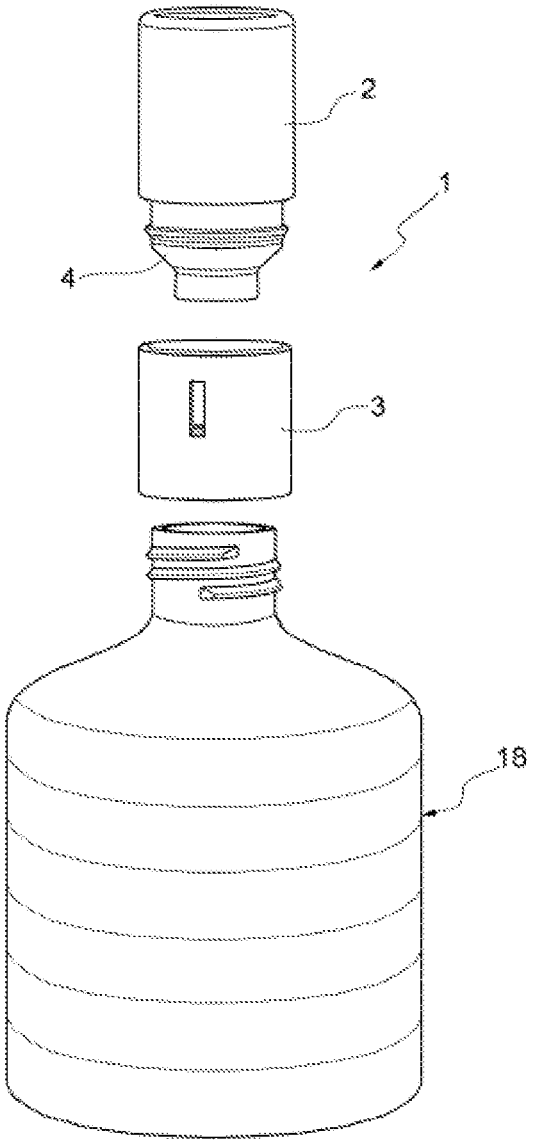
FIG. 3 is a front view, on a larger scale, of the vessel of FIG. 2.

As shown in FIG. 3, the container 2 has a universal neck 4. That is to say that, whatever the size and shape of the container 2, the neck 4 will be identical from one container to another.

Figure 5:
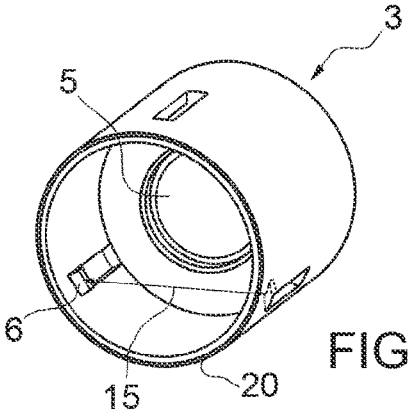
FIG. 5 is a perspective view of the rear of the adapter of the vessel of FIG. 2.
Figure 4:
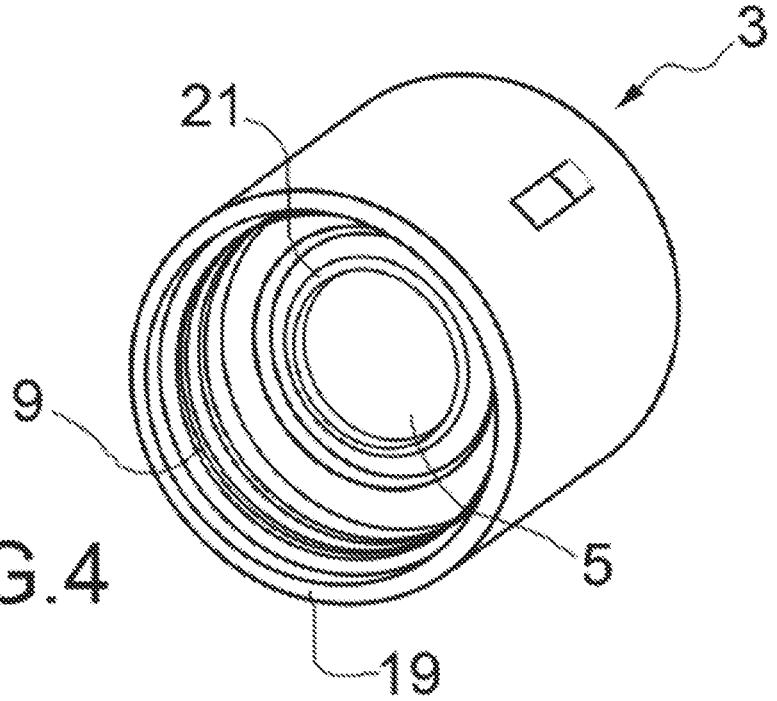
FIG. 4 is a perspective view of the front of the adapter of the vessel of FIG. 2.
Figure 4A:
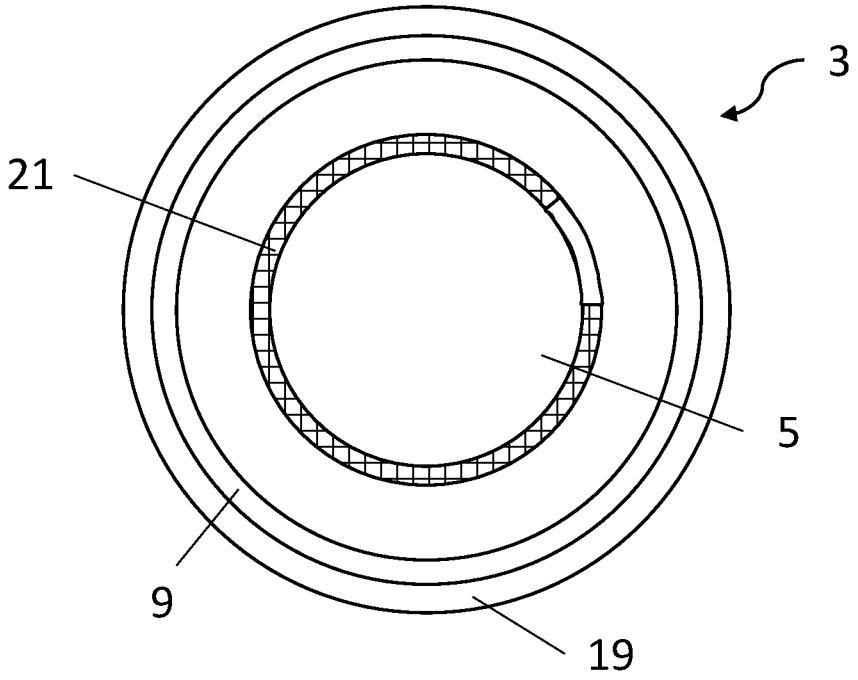
FIG. 4A is a front view of the adapter of the vessel of FIG. 2.

As shown in FIGS. 4 and 5, the adapter 3 of the vessel 1 comprises an adapter skirt 20 and a fastening skirt 19.

The fastening skirt 19 here comprises a tapping 9 to be screwed onto the neck of any bottle 18. Alternatively, the fastening skirt 19 may be fixed on the neck of any receiving vessel 18 with the aid of a bayonet type fixing, the neck of the vessel being adapted accordingly. The adapter skirt 20 allows to fix the adapter 3 on the neck 4 of the container 2, here using pins 6.

The adapter 3 also includes a removable seal 5, which allows the whole of the vessel 1 to be closed hermetically until the product contained in the vessel 1 is being used. The seal 5 is attached to the adapter along a tear line 21 and, because of its mobility, along a hinge area, around which the seal can thus rotate after the tear line is broken.

The primary object of the invention is to have a vessel 1 able to contain any volume of product, and to be fixed on a bottle 18 having a neck of any size.

To do this, the container 2 is an element of any size or shape that can contain any type of product. In this way, the volume of the container 2 is variable depending on the situations.

Furthermore, the adapter 3 has a diameter of any size, which allows it to be screwed adequately on the neck of any bottle 18 by means of the fastening skirt 19 comprising a tapping 9. The adapter 3 is fixed on the universal neck 4 of the container 2 by means of the pins 6. These pins 6 have a length that varies with the diameter of the adapter so that the distance 15 between these pins 6 is always the same. Thanks to this, the internal diameter formed by the pins is a constant diameter, corresponding to the outside diameter of the universal neck of the container. This allows to clip any size of adapter 3 to any size of container 2, given that they both have a universal neck 4 whose dimensions never vary.

Having described the vessel 1, its use will now be described. The user will choose the adequate vessel 1, that is to say one comprising a container 2 of desired volume clipped on an adapter 3 having its fastening skirt 19 adapted to the size of the neck of the bottle 18. The user will then screw the vessel 1, until then hermetically closed by the seal 5, on the neck of the bottle 18. The neck will exert a pressure on the seal 5, which will cause the detachment of the latter along the tear line 21. The seal 5 then opens the vessel 1 to release its contents which will flow into the bottle 18.

Alternatively, the attachment of the adapter on the container may be provided by means other than those described above, for example with an expandable bead squeezing the neck of the container.

The invention claimed is:

1. Mixing vessel (1) for containing a product to be mixed with another product in a receiving vessel (18), said mixing vessel (1) comprising a container (2) and an adapter (3), said container (2) comprising a neck (4) intended to be mounted on a neck of the receiving vessel (18) via the adapter (3), the neck (4) of the container (2) being a universal neck that may be used on any receiving vessel (18) comprising a neck, said adapter (3) comprising an adapter skirt (20) for the container (2) and a threaded fastening skirt (19) for the receiving vessel (18) between which a removable seal (5) is located for hermetic sealing of the mixing vessel and arranged to open the mixing vessel (1) by direct pressure of the neck of the receiving vessel upon screwing on the removable seal causing the tearing of the removable seal, on the receiving vessel (18) so that the product of the mixing vessel (1) and the product of the receiving vessel (18) can mix.

2. The vessel according to claim 1, wherein the adapter skirt (20) comprises pins (6) for attachment to the neck (4) of the container (2).

3. The vessel according to claim 1, wherein the seal (5) is joined to the adapter along a tear line extending a hinge area.

4. Adapter for acting as an intermediate between a container (2) of a mixing vessel (1) and a receiving vessel (18), said adapter (3) comprising an adapter skirt (20) and a fastening skirt (19), said adapter skirt (20) comprising means for fixing on a neck (4) of a container (2) and said fastening skirt (19) being intended to be fixed on a neck of a receiving vessel (18), said adapter (3) comprising a removable seal (5) designed to open a passage between the mixing vessel (1) on the receiving vessel (18) in response to pressure exerted on the seal by the neck of the receiving vessel causing the tearing of the removable seal so that a first product in the mixing vessel (1) and a second product in the receiving vessel (18) can mix.

* * * * *